United States Patent [19]

Conner et al.

[11] Patent Number: 4,660,818

[45] Date of Patent: Apr. 28, 1987

[54] UNSTRAPPING APPARATUS

[75] Inventors: Trevor J. Conner, Cowplain; Michael G. Jackson, Warsash, both of United Kingdom

[73] Assignee: De La Rue Systems Limited, London, England

[21] Appl. No.: 682,845

[22] Filed: Dec. 18, 1984

[30] Foreign Application Priority Data

Dec. 20, 1983 [GB] United Kingdom ..... 8333856

[51] Int. Cl.[4] ..... B65H 39/00; B23P 19/00; B07C 5/00

[52] U.S. Cl. ..... 270/1.1; 29/33.52; 29/426.3; 29/564.3; 83/909; 209/534; 270/53

[58] Field of Search ..... 209/534; 29/33.5, 33.52, 29/426.1, 426.3, 564.1, 564.3; 83/909, 924; 270/53, 1.1

[56] References Cited

U.S. PATENT DOCUMENTS

| | | | |
|---|---|---|---|
| 2,820,282 | 1/1958 | Schneider, Jr. | 83/909 X |
| 4,166,030 | 8/1979 | Lewis et al. | 209/534 |
| 4,236,639 | 12/1980 | Boettge et al. | 209/534 |
| 4,404,723 | 9/1983 | Ohba et al. | 83/909 X |
| 4,414,730 | 11/1983 | Ohmura et al. | 29/426.3 |
| 4,553,312 | 11/1985 | Mitzel et al. | 29/33.52 X |
| 4,586,232 | 5/1986 | Ohmura et al. | 209/534 X |

FOREIGN PATENT DOCUMENTS

| | | | |
|---|---|---|---|
| 0100990 | 2/1984 | European Pat. Off. | 29/564.3 |
| 0106277 | 4/1984 | European Pat. Off. | 209/573 |
| 2729830 | 1/1979 | Fed. Rep. of Germany | 29/56.5 |
| 0738960 | 6/1980 | U.S.S.R. | 83/924 |

OTHER PUBLICATIONS

*Toshiba Currency Note Arranger", Toshiba Review, No. 130, Nov.-Dec. 1980.*

*Primary Examiner*—Robert B. Reeves
*Assistant Examiner*—Edward M. Wacyra
*Attorney, Agent, or Firm*—Cushman, Darby & Cushman

[57] ABSTRACT

Unstrapping apparatus for removing a strap (2) from a pack of sheets (1) initially contained in the strap is described. The apparatus comprises an input station including a blade (31) for cutting the strap (2) and a hook (59) for engaging the cut strap and carrying the strap to an association station (72). A feed transfer module (79) passes the unstrapped sheets to a doubles detect system and an authentication system (81, 83) for sorting the sheets into acceptable and unacceptable sheets. Unfit sheets, as determined by the doubles detect and authentication systems (81, 83) are transported to the association station (72) where they are stapled by a stapler (73) with the strap (2).

12 Claims, 5 Drawing Figures

UNSTRAPPING APPARATUS

The invention relates to unstrapping apparatus for removing a strap from a pack of sheets initially contained in the strap. In particular, the invention relates to the unstrapping of packs of currency such as banknotes.

It is desirable when sorting banknotes, bonds, securities or other security documents to determine the origin of documents which fail tests for genuineness or are otherwise unacceptable in that they are torn or creased. In the past this has involved manually removing a strap from, for example, a pack of banknotes and then associating the strap later with banknotes from the same pack found to be unacceptable. This method suffers from a high risk that the strap will be lost or will be associated with the wrong notes.

In accordance with the present invention, unstrapping apparatus for removing a strap from a pack of sheets initially contained in the strap comprises an input station including separation means for separating the strap from the sheets; feed means for passing the unstrapped sheets to means for sorting the sheets into acceptable and unacceptable sheets; transport means for transporting the strap and unacceptable sheets, as determined by the sorting means, to an association station; and means for associating the unacceptable sheets with the strap at the association station.

With this invention, the origin of forged or otherwise unprocessable sheets is known since the original strap is associated with the unacceptable sheets automatically by the apparatus. This is particularly advantageous where the unstrapping apparatus processes a large number of packs of sheets in series since otherwise it would be necessary to unstrap and sort each pack individually which is clearly time consuming.

Preferably, the transport means comprises at least one pivotally mounted hook which engages the strap in use, and is pivotable to carry the strap from the input station to the association station.

The use of a hook provides a particularly simple method by which transportation of the strap can be achieved and it is particularly convenient if the or each hook cooperates with a moving surface whereby the strap is trapped between the hook and the surface when the strap is carried to the association station.

Conveniently, three pivotally mounted hooks are provided equally spaced about the surface of a rotating drum or wheel. This enables more than one pack of sheets to be processed by the apparatus at the same time. Thus, one pack may be positioned at the input station, and the strap and unacceptable sheets from the preceding pack can be positioned at the association station.

Preferably, the apparatus further comprises a cam fixed relatively to the hook or hooks, the or each hook including a cam follower engaging the cam and having means for urging the cam follower into engagement with the cam, wherein the cam is shaped such that the or each hook moves away from the moving surface as the hook approaches the input station and a reject station. For example, the or each hook may be urged radially inwardly by one or more compression springs.

In one example, the apparatus may further comprise printing means for printing information relating to the unacceptable sheets on a record sheet; and means for passing the record sheet to the association station for association with the unacceptable sheets and the strap. This record medium may be a tally ticket which carries information such as the number of unacceptable sheets which have been detected. The printing means may be a thermal printer.

The strap may be associated with the unacceptable sheets in any convenient manner but preferably the apparatus further comprises stapling means for stapling the strap, and where appropriate a printed record sheet, to the unacceptable sheets at the association station. This ensures that the strap and unacceptable sheets are securely associated.

An example of unstrapping apparatus in accordance with the present invention will now be described with reference to the accompanying drawings, in which.

Figure 1:
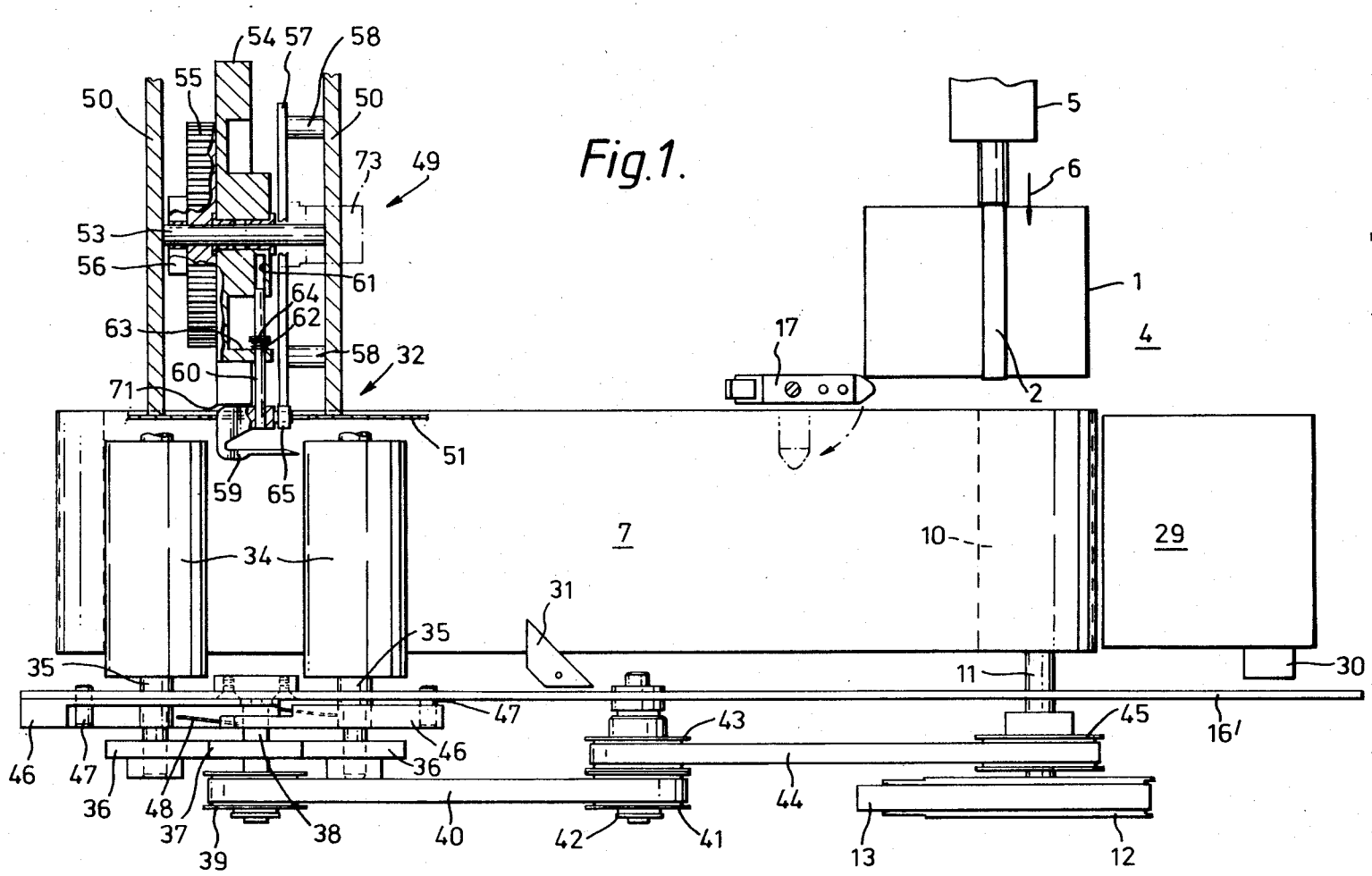
FIG. 1 is a plan view of the apparatus, partly in section, and with some parts omitted for clarity.

The apparatus illustrated in the drawings is for unstrapping packs of security documents such as bank notes. Packs of bank notes 1 each enclosed in a paper band 2 are initially placed in a hopper 3. The hopper 3 has an outlet opening (not shown) through which single packs of notes 1 can be fed on to a support surface 4. The detailed construction of the hopper 3 is not shown since it does not relate directly to the present invention but will be readily apparent to a person skilled in the art. A piston/cylinder arrangement 5 is also mounted on the support surface 4 and when actuated pushes the pack of notes 1 along the surface 4 in the direction of an arrow 6. It should be understood that the control of the various components such as the piston/cylinder arrangement 5 may be by mechanical means or via a suitably programmed microcomputer 25.

A conveyor belt 7 is positioned adjacent to and flush with the support surface 4. The conveyor belt 7 is entrained around idler rollers 8, a tensioning roller 9 and a drive roller 10. The drive roller 10 is mounted non-rotatably on an axle 11 connected non-rotatably to a pulley 12. A drive belt 13 is entrained around the pulley 12 and a pulley 14 of a drive motor 15. The various components described are mounted between walls of the apparatus one of which 16 is indicated schematically in FIG. 2.

Figure 4:
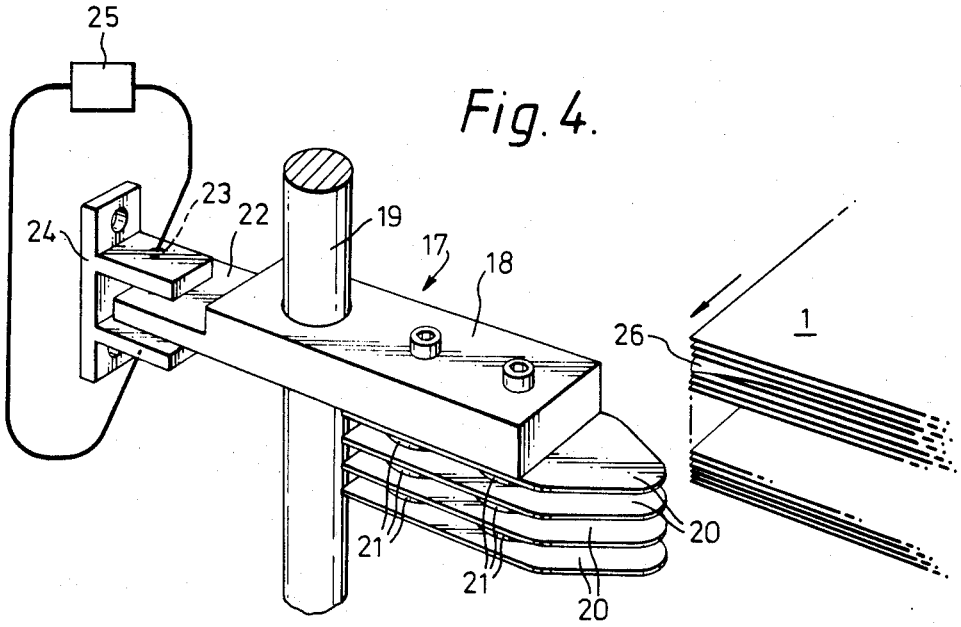
FIG. 4 is a perspective view of the folded note detector shown in FIG. 1.

As the pack of notes 1 is pushed towards the conveyor belt 7 an edge of the pack is engaged by a folded note sensor 17. The folded note sensor 17 (FIG. 4) comprises an arm 18 mounted on a pivotable rod 19 connected to a base of the apparatus (not shown). Four vanes 20 spaced apart by spacers 21 are mounted under the arm 18. The vanes 20 project into the path of the pack of notes 1. An end 22 of the arm 18 remote from the vanes 20 is positioned normally between a light emitting diode 23 and a photodetector (not shown) mounted in opposite arms of a bracket 24. The light emitting diode 23 and photodetector are connected to the microcomputer 25. The rod 19 is spring biased to the position shown in FIG. 4.

As the pack of notes reaches the folded note detector 17 the vanes 20 will pass between notes of the pack. In this situation, no pivotable movement will occur and light from the LED 23 will not pass to the photodetector. However, if a folded note is present in the pack 1 as for example illustrated at 26 in FIG. 4, this will prevent the vanes 20 sliding through the pack of notes 1. In this event, the arm 18 and the rod 19 will pivot against the spring action thus moving the end 22 of the arm 18 out from between the two arms of the bracket 24. This will allow the optical path between the LED 23 and photodetector to be completed and a signal will pass to the microcomputer 25.

Whether or not the edge sensor 17 detects a folded note, the pack 1 will be pushed by the piston/cylinder arrangement 5 on to the conveyor 7. If a folded note is detected, the microcomputer 25 will cause the motor 15 to drive the conveyor belt 7 towards a reject hopper (not shown) in a direction 28 via a chute 29. The passage of the rejected pack is recorded by sensors 30 connected to the microcomputer 25 which ensures that the rejected pack is clear of the conveyor 7 prior to a subsequent pack being advanced from the hopper 3. The edge sensor 17 will then return to the position shown in FIG. 1 under spring action.

In the normal situation, however, a folded note will not be detected and the conveyor belt 7 will be caused to carry the pack of notes 1 to the left as seen in FIG. 1 to an input statiion. A knife blade 31 is fixed beside the conveyor belt at the entrance to the input station and projects into the path of the pack of notes 1. As the pack of notes 1 is carried past the knife blade 31, the blade will slice through the paper band 2 in preparation for the unstrapping stage. The pack of notes 1 is then carried by the conveyor belt 7 to an unstrapping station 32 forming a downstream part of the input station.

Figure 2:
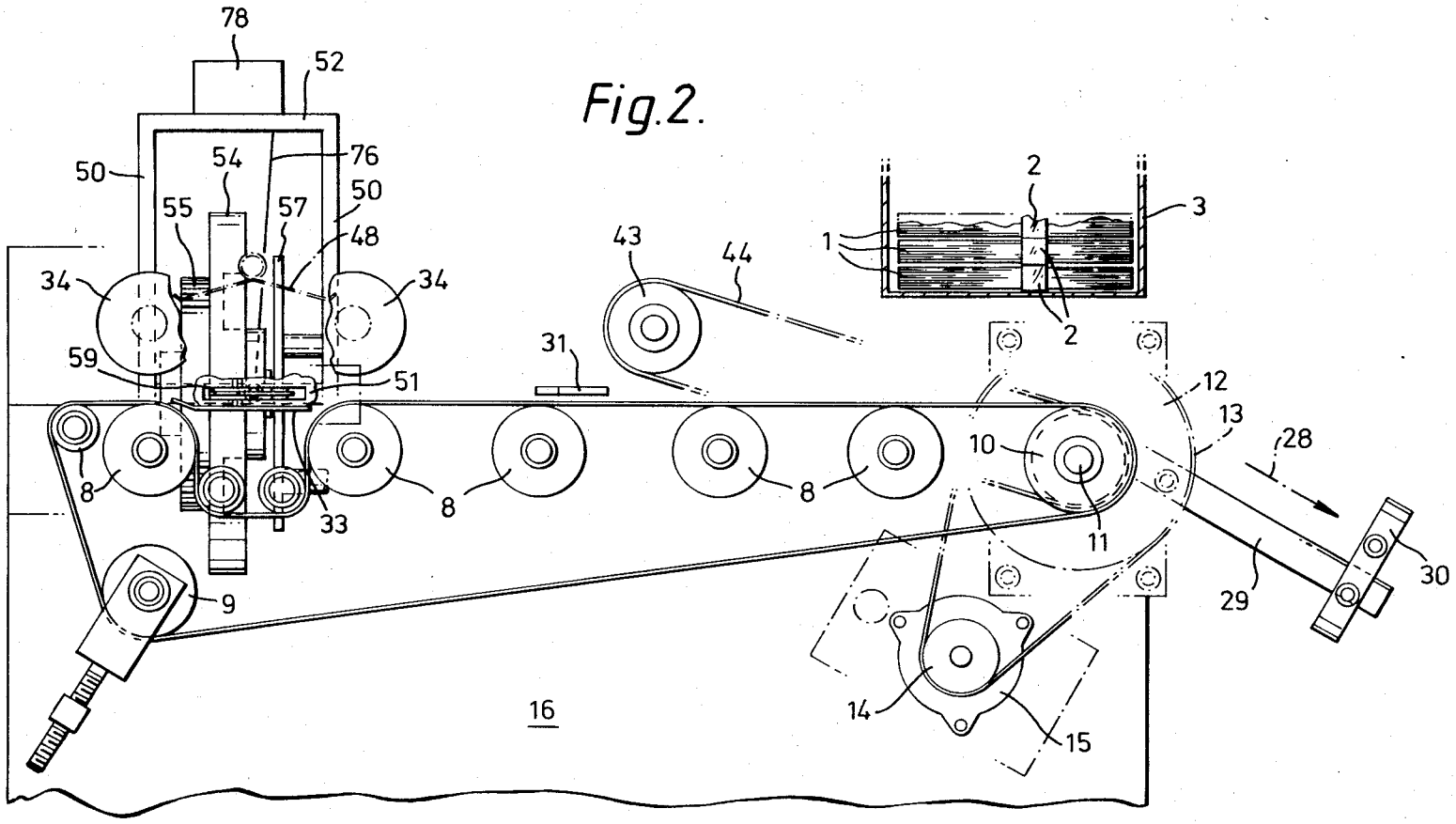
FIG. 2 is a side elevation, partly in section, and with some parts omitted for clarity.

As can be seen in FIG. 2, at the unstrapping station 32 the conveyor belt 7 is guided downwardly while the notes are carried on to a support plate 33. The pack of notes 1 is longer than the support plate 33 so that at all times a part of the pack engages the conveyor belt 7. A pair of rollers 34 are mounted above a pair of the idler rollers 8 on respective axles 35. The axles 35 pass through apertures (not shown) in a wall part 16' of the apparatus. The axles 35 terminate in toothed gears 36 which engage a drive gear 37 mounted on an axle 38 supported in the wall part 16'. A pulley 39 is non-rotatably mounted on the axle 38 and has a drive belt 40 entrained around it. The drive belt 40 is also entrained around a pulley 41 mounted non-rotatably on an axle 42 supported in the wall part 16'. Another pulley 43 is non-rotatably mounted on the axle 42 and has a drive belt 44 entrained around it. The drive belt 44 is entrained about a pulley 45 non-rotatably mounted on the axle 11. Thus, the motor 15 which causes rotation of the pulley 12 also causes rotation of the pulley 45 and thus via the pulleys 43, 41, and 39 rotation of the drive wheels 37, 36 and hence the rollers 34.

The rollers 34 are mounted at each end in pivotal support arms 46. (Only one pair of the arms 46 is shown in the drawings.) The arms 46 are pivotally mounted to the wall part 16' via pins 47 and are pivoted about the axle 38. The arms 46 are urged in a downward direction, as seen in FIG. 2, by a spring 48. In this way, the rollers 34 are urged towards the corresponding idler rollers 8.

A hook assembly 49 is mounted on the same side of the conveyor belt 7 as the hopper 1. The hook assembly 49 comprises a housing having side walls 50, a lateral wall 51 lying alongside the conveyor belt 7 and a top wall 52. An axle 53 is mounted between the side walls 50 and carries rotatably a hook supporting disc 54. A toothed drive wheel 55 is fixed to the disc 54 by means of a gripping disc 56. A disc-like cam 57 is fixed to the right-hand side wall 50, as seen in FIG. 1, via spacers 58.

Figure 3:
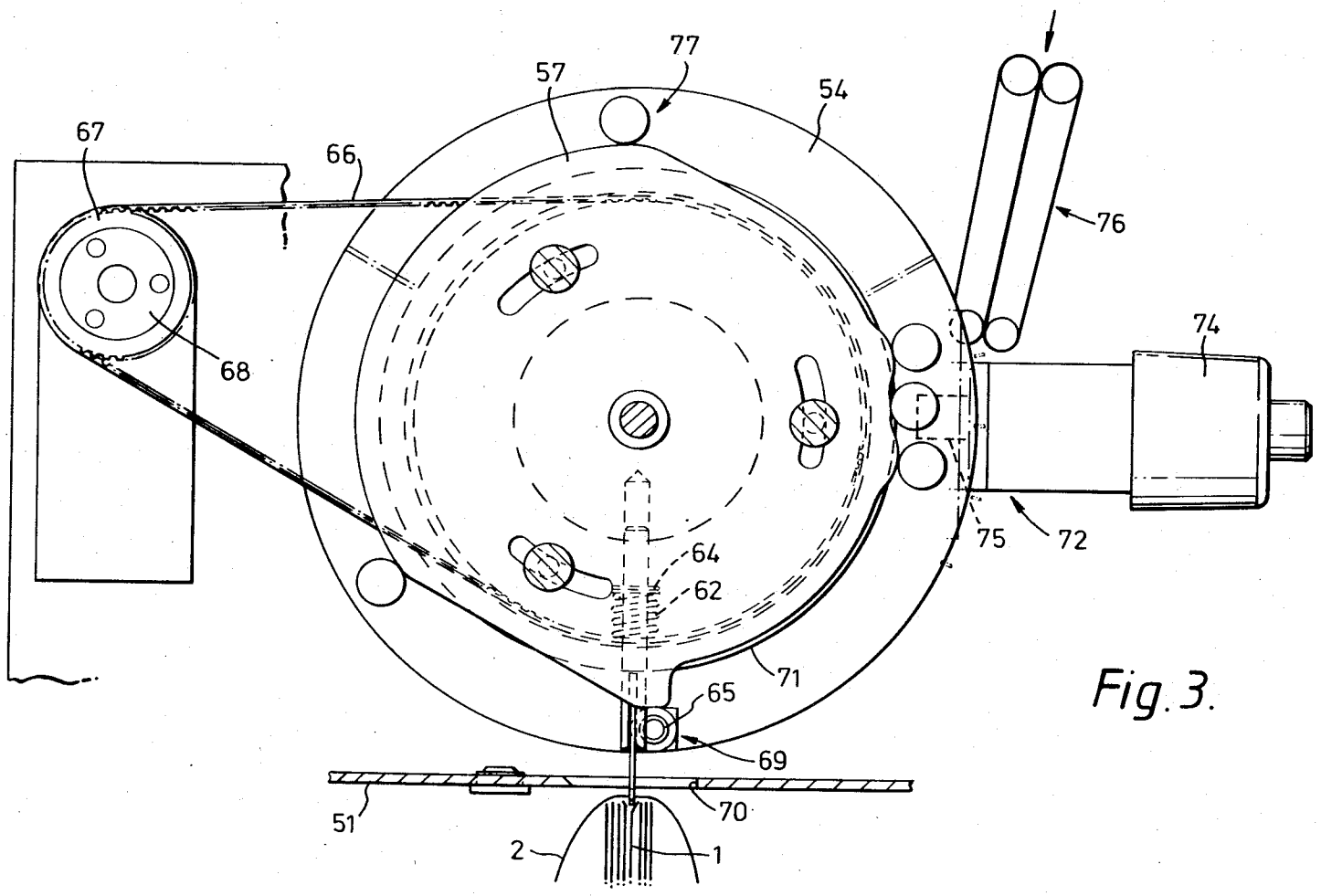
FIG. 3 illustrates the hook mechanism shown in FIGS. 1 and 2 in more detail.

Three hooks 59 mounted on shafts 60 are supported by the disc 54. Only one hook is illustrated in FIGS. 1 and 3 for clarity. Each shaft 60 extends into a bore 61 of the disc 54 and is urged into the bore by means of a compression spring 62 acting between a flange part 63 of the disc 54 and a flange 64 fixed on the shaft 60. Each hook 59 carries a cam follower in the form of a wheel 65. The shape of the cam 57 is illustrated in FIG. 3.

A toothed drive belt 66 is entrained around the drive wheel 55 and around a pulley 67 of a drive motor 68. The drive motor 68 causes rotation of the disc 54 in an anti-clockwise direction as seen in FIG. 3. This corresponds to the hook 59 seen in FIG. 1 moving away from the paper.

The shape of the cam 57 is such that as a hook 59 approaches the unstrapping station 32 the cam follower 65 is forced radially outwardly to the position shown at 69 in FIG. 3. In this position, the hook 59 extends through an aperture 70 in the lateral wall 51. As a pack of notes reaches the unstrapping station 32, the hook 59 will engage behind the band 2 so that on further movement of the pack 1 under the control of the conveyor belt 7 and the roller 34 the band 2 will be restrained by the hook 59 and remain on the hook leaving the pack unstrapped. The motor 68 then causes rotation of the disc 54. The cam follower 65 immediately moves radially inwardly under the influence of the compression spring 62 so that the hook 59 is retracted through the aperture 70. The band 2 engaged by the hook 59 is trapped between the hook 59 and a part 71 of the disc 54.

The trapped band is carried within the housing 49 to an association or stapling station 72. The stapling station 72 comprises a conventional stapler 73 mounted to one of the walls 50 and extending in front of the disc 54, as seen in FIG. 1. The stapler 73 is solenoid operated via a solenoid 74 and has an anvil 75. The cam 57 is so shaped at the stapling station 72 that the hook 59 is caused to move radially outwardly by a small amount and then radially inwardly to carry the band into the anvil 75. At the same time, a tally ticket which has previously been generated and unacceptable notes from the original pack are fed along a conveyor system 76 to the stapling station 72. This will be described in more detail below. The solenoid 74 is then actuated to cause the band, unacceptable notes, and tally ticket to be stapled together. Further rotation of the disc 54 then takes place the cam follower being urged radially outwardly (to enable the hook to carry the stapled packet out from the anvil 72) and then radially inwardly to hold the packet against the part 71 of the disc 54. Subsequently, the cam 57 causes the cam follower 65 to move radially outwardly again as shown at a position 77 in FIG. 3. The pack is then no longer trapped and either falls off the hook 59 or may be guided off the hook 59 into a reject hopper (not shown).

It should be understood that since there are three hooks 59, an increase in the rate of processing is achieved over the case where only a single hook is used.

The tally ticket referred to above is printed by a thermal printer 78 mounted on the upper wall 52 of the hook assembly housing. The tally ticket may carry information such as the reasons for rejection of the unacceptable notes. The tally ticket is then passed along the conveyor system 76 to the stapling station 72.

Figure 5:
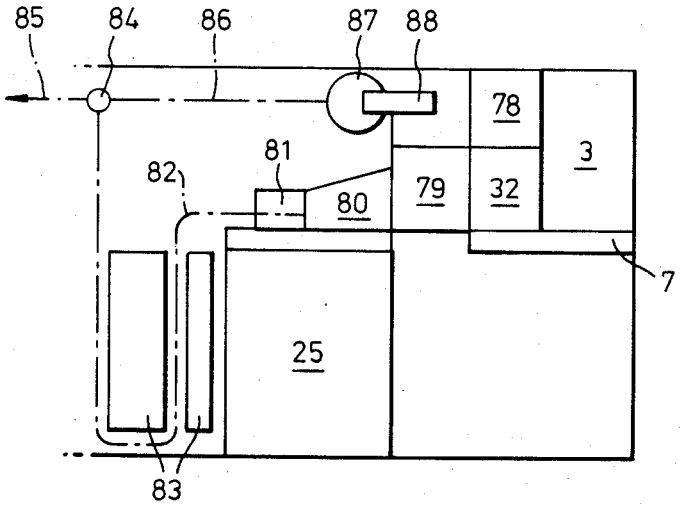
FIG. 5 is a block diagram illustrating the interface between the apparatus and authentication apparatus.

The association between the unstrapping apparatus and authentication apparatus is shown in block diagram form in FIG. 5. FIG. 5 illustrates the hopper 3, conveyor belt 7, the unstrapping station 32 and the printer 78. The unstrapped pack of notes is transferred via a conventional feed transfer module 79 to a feed table 80 which feeds single notes to a doubles detect system 81. The system 81 is of conventional form and determines whether two or more notes have been fed simultaneously and incorrectly. Notes from the doubles detect system 81 are carried along a feed path 82 through an authentication system 83 which carries out conventional checks on the bank notes for authenticity. Output signals from the authentication system 83 and the doubles detect system 81 are processed by the microprocessor 25 which controls a diverter 84. If acceptable notes are detected, i.e., authentic and non-doubles they are diverted by the diverter 84 along a feed path 85 to further authentication or stacking and banding apparatus. Alternatively, if unacceptable notes are detected the diverter 84 passes these along a feed path 86 to a conventional stacking wheel 87 where they are stacked on to a conveyor system 88 which carries the unacceptable stack of notes to the stapling station 75.

We claim:

1. Unstrapping apparatus for removing a strap from a pack of sheets initially contained in said strap comprising an input station and an association station, said input station including separation means for separating said strap from said sheets; means for sorting said sheets into acceptable and unacceptable sheets; feed means for passing unstrapped sheets to said sorting means; first transport means for transporting said unacceptable sheets, as determined by said sorting means, to said association station; and second transport means having at least one hook for engaging said strap, and rotatable to carry said strap from said input station to said association station; and said association station including means for associating said unacceptable sheets with said strap at said association station.

2. Apparatus according to claim 1, said apparatus further comprising means defining a moving surface, wherein said at least one hook cooperates with said moving surface whereby said strap is trapped between said hook and said moving surface when said strap is carried to said association station.

3. Apparatus according to claim 2, wherein three rotatably mounted hooks are provided equally spaced about said surface.

4. Apparatus according to claim 2 wherein said moving surface is defined by one of a rotating drum and a wheel.

5. Apparatus according to claim 2, said apparatus having a reject station and further comprising a cam fixed relatively to said at least one hook, said at least one hook including a cam follower engaging said cam and having means for urging said cam follower into engagement with said cam, wherein said cam is shaped such that said at least one hook moves away from said moving surface as said hook approaches said input station and said reject station.

6. Apparatus according to claim 2, said apparatus having a reject station and further comprising a cam fixed relatively to said at least one hook, said at least one hook including a cam follower engaging said cam and having means for urging said cam follower into engagement with said cam, wherein said cam is shaped such that said at least one hook moves away from said moving surface as said hook approaches said input station and said reject station.

7. Apparatus according to claim 1, further comprising printing means for printing information relating to said unacceptable sheets on a record sheet; and means for passing said record sheet to said association station for association with said unacceptable sheets and said strap.

8. Apparatus according to claim 7, further comprising stapling means for stapling said strap and said printed record sheet to said unacceptable sheets at said association station.

9. Apparatus according to claim 1, further comprising stapling means for stapling said strap to said unacceptable sheets at said association station.

10. Apparatus according to claim 1, wherein said separation means includes means defining a cutting edge which is provided at said input station for cutting through said strap.

11. Banknote sorting apparatus comprising unstrapping apparatus according to claim 1 for unstrapping packs of banknotes; an output station; and sorting means for sorting said unstrapped banknotes into acceptable and unacceptable notes and for feeding acceptable notes to said output station and unacceptable notes to said association station of said unstrapping apparatus.

12. Unstrapping apparatus for removing a strap from a pack of sheets initially contained in said strap, said apparatus comprising a hopper for storing packs of sheets; an input station and an association station; conveying means for conveying said packs from said hopper to said input station, said input station having a blade defining a cutting edge whereby said cutting edge cuts through said strap as said pack is conveyed by said conveying means, and wherein said input station includes three hooks mounted on a rotating wheel, and a cam fixed relatively to said hooks, said hooks including a cam follower engaging said cam and having means for urging said cam follower into engagement with said cam, wherein said cam is shaped such that said hooks move away from said wheel as said hooks approach said input station; feed means for passing said unstrapped sheets to means for sorting said sheets into acceptable and unacceptable sheets; and stapling means at said association station for stapling said strap to said unacceptable sheets.

* * * * *